US005839233A

United States Patent [19]

Smit

[11] Patent Number: 5,839,233

[45] Date of Patent: Nov. 24, 1998

[54] LOUVRE TYPE ROOF STRUCTURES

[76] Inventor: Dirk Van Zyl Smit, 190 Aldo Street, Sinoville, Pretoria, Gauteng, South Africa

[21] Appl. No.: 710,030

[22] Filed: Sep. 11, 1996

Related U.S. Application Data

[63] Continuation-in-part of Ser. No. 529,412, Aug. 10, 1995, abandoned.

[51] Int. Cl.[6] ..... E04B 7/00

[52] U.S. Cl. ..... 52/198; 49/74.1; 454/250; 454/281; 454/358

[58] Field of Search ..... 52/198, 730.4, 52/731.2, 736.1, 737.1; 403/381; 454/250, 275, 276, 278, 281, 314, 358, 367; 49/74.1, 79.1, 403

[56] References Cited

U.S. PATENT DOCUMENTS

| | | | |
|---|---|---|---|
| 2,230,628 | 2/1941 | Sahlberg | 52/731.2 X |
| 3,741,102 | 6/1973 | Kaiser | 98/110 |
| 5,178,353 | 1/1993 | Huxtable | 403/381 X |
| 5,180,250 | 1/1993 | Ferro | 403/381 X |
| 5,306,210 | 4/1994 | Smit | 454/250 |
| 5,590,504 | 1/1997 | Heard et al. | 52/736.1 X |

FOREIGN PATENT DOCUMENTS

| | | | |
|---|---|---|---|
| 2652620 | 4/1991 | France | 403/319 |
| 406229067 | 8/1994 | Japan | 52/737.1 |

*Primary Examiner*—Christopher Kent
*Assistant Examiner*—Timothy B. Kang
*Attorney, Agent, or Firm*—Ladas & Parry

[57] ABSTRACT

A louvre type roof structure includes a plurality of parallel slats mounted on carrier elements which in turn are mounted on carrier beams such as to permit pivotal displacement of the carrier elements and the slats between a closed position in which the slats are disposed in a roughly coplanar orientation, and an open position in which the slats are disposed in spaced apart generally parallel planes. The carrier elements are secured to the slats by engaging the slats without penetrating the slats, so that each slat is located in a fixed planar orientation relative to the respective carrier. Mounting of the carrier elements to the carrier beams is by means of a pair of mounting levers for each carrier element. One of the pair of mounting levers is a fixed lever securable to a carrier beam in a selected position, and the other lever is a free lever displaceable relative to a carrier beam. Each fixed lever is rotatably attached to its carrier element, and each free lever is fixedly attached to its carrier element to permit pivotal displacement of such carrier element relative to the fixed lever and carrier beam when the free lever is displaced relative to the carrier beam. Each fixed lever has releasable attachment formations for releasably attaching the lever to a carrier beam in a selected position. By way of development, each carrier beam may be in the form of an elongate carrier strip and a beam, the carrier strip being fastened on the beam.

9 Claims, 10 Drawing Sheets

LOUVRE TYPE ROOF STRUCTURES

CROSS-RELATED APPLICATION

This Application is a Continuation in Part of U.S. Ser. No. 08/529,412 filed Aug. 10, 1995, now abandoned.

FIELD OF THE INVENTION

This invention relates to adjustable roof structures, more particularly louvre type roof structures.

BACKGROUND AND PRIOR ART

The present invention concerns improvements in and modifications of the invention (hereinafter referred to as the "earlier invention") entitled "Louvre Type Roof Structures" in respect of which the present Applicant has filed a U.S. patent application Ser. No. 07/928,789 on Aug. 12, 1992, now U.S. Pat. No. 5,306,210 issued Apr. 26, 1994 (hereinafter referred to as the "earlier patent"). The complete specification of the main application will hereinafter be referred to as the "earlier specification" and is incorporated herein insofar as it is relevant, by way of reference.

The earlier specification describes and claims a louvre type roof structure including a plurality of parallel slats mounted on carrier beams extending transversely to the slats, in which the slats are mounted on carrier elements, which carrier elements are in turn mounted on the carrier beams to permit pivotal displacement of the carrier elements and of the slats between a closed position in which the slats are disposed in a roughly coplanar position, and an open position in which they are disposed in spaced apart parallel planes, the carrier elements further being secured to the slats by means of securing means engaging the slats without penetrating said slats and in such a manner that a slat will be located in a fixed planar position relative to a carrier element to which it is secured.

The earlier specification further describes and claims that the carrier elements are mounted on the carrier beams by means of mounting levers, a pair of mounting levers being provided in respect of each carrier element, one of a pair of levers being a fixed lever and being secured to the carrier beam in a fixed position, and the other one being a free lever and being displaceable relative to the carrier beam, the fixed lever of a pair further being rotatably attached to its carrier element and the free lever of a pair being fixedly attached to its carrier element to permit pivotal displacement of the carrier element relative to the fixed lever and the carrier beam when the free lever is displaced relative to the carrier beam.

As explained in the earlier specification, the fixed lever of each pair of mounting levers may be mounted on the carrier beam in a fixed generally upright position, the fixed lever having a first fixed end, conveniently a lower end, fixedly attached to the carrier beam and a second end, conveniently an upper end, rotatably attached, such as with a rivet, to the carrier element to permit pivotal movement of the carrier element relative to the fixed lever. The free lever of each pair may have a first fixed end, conveniently an upper end, fixedly attached, such as with rivets, to the carrier element, and a lower end which is free to carry out reciprocal arcuate movement. The arrangement may be such that reciprocal arcuate movement imparted to the free end of the free lever will bring about pivotal displacement of the carrier element about a substantially horizontal axis, between the aforesaid open and closed positions. Such displacement of the carrier elements will bring about corresponding pivotal displacement of the slats mounted thereon, between the aforesaid open and closed positions. The free ends of adjacent free levers may be interconnected by means of a connector rod.

The first fixed end of the fixed lever is shown in the drawings forming part of the earlier specification, to be so fixedly attached to the carrier beam by welding.

The Applicant has now devised certain modifications on improvements to the louvre type roof structure as disclosed in the earlier specification, which entail significant practical advantages in relation to the manufacture of the components for the roof structure, and the construction of the roof structure itself.

SUMMARY OF THE INVENTION

According to one aspect of the present invention, a fixed lever is provided at its first end to be secured to a carrier beam with releasable attachment means, by means of which it may releasably be attached to the carrier beam in a selected position. If desired, the carrier beam may be provided with complementary attachment means, for engaging with the attachment means of the fixed lever.

Thus, the present invention provides a louvre type roof structure including a plurality of parallel slats mounted on carrier beams, which structure includes

- a plurality of carrier elements on which a said plurality of slats are mountable;
- mounting means for mounting the carrier elements on the carrier beams to permit pivotal displacement of the carrier elements and the said slats mounted thereon between a closed position in which the slats are disposed in a roughly coplanar orientation, and an open position in which the slats are disposed in spaced apart generally parallel planes;
- securing means for securing the carrier elements to the slats to engage the slats without penetrating the slats so that a slat will be located in a fixed planar orientation relative to a carrier element to which it is secured;
- the said mounting means comprising a pair of mounting levers provided in respect of each of said carrier elements, one of a said pair of mounting levers being a fixed lever securable to a carrier beam in a selected position, and the other one of a said pair of levers being a free lever displaceable relative to a said carrier beam;
- a said fixed lever of a pair being rotatably attached to its carrier element, and a said free lever of a pair being fixedly attached to its carrier element to permit pivotal displacement of such carrier element relative to such fixed lever and carrier beam when the free lever is displaced relative to the carrier beam;
- a said fixed lever being provided with releasable attachment means for releasably attaching the lever to a said carrier beam in a selected position.

As indicated above, a said carrier beam may be provided with complementary attachment means, for engaging with the attachment means of a said fixed lever. The carrier beam may be arranged to extend transversely to the slats.

It will be appreciated that the provision of fixed levers with releasable attachment means as envisaged by the present invention, entails the advantage that such levers may be attached to the carrier beams as required on site, without the need for sophisticated tools and equipment, such as welding equipment. Furthermore, to ensure accurate alignment of the carrier elements, and consequentially accurate closure of the louvre slats, the position of the fixed levers on the carrier beams may be adjusted on sited, as required.

The attachment means on the fixed lever and the complementary attachment means on the carrier beam may be complementary male and female engagement formations, e.g. complementary tongue-and-groove formations, complementary hook-and-groove formations, or the like. For example, the fixed lever may be provided with a pair of spaced protruding tongue formations, and the carrier beam may have a pair of spaced grooves, the spacing of the tongue formations being equidistant to the spacing of the grooves to permit the tongue formations to be releasably engaged within the grooves. The arrangement may be such that the fixed lever may resiliently be deformed to engage the tongue formations within the grooves.

The configuration and dimensions of the complementary male and female engagement formations may be such as to withstand a disengagement or lifting force of up to about 100 $kg/m^2$.

In one embodiment, the fixed lever may be of generally L-shaped configuration, having an upright arm to be arranged in generally vertical orientation in use, and a transverse limb to be arranged in generally horizontal orientation in use. The protruding tongue formations may be a pair of spaced and in use generally downwardly protruding tongue formations provided on the transverse limb, e.g. on the underside thereof. A pair of complementary spaced grooves may be provided on an in use generally upwardly directed face of the carrier beam, so that a fixed lever may be mounted on a carrier beam so that the upright arm is arranged in a generally vertical orientation when the tongue formations on the transverse limb of the lever are engaged in the complementary grooves in the carrier beam.

In an alternative embodiment of the carrier beam, a pair of laterally facing grooves may be provided in opposed and in use generally outwardly directed lateral faces, e.g. on side walls of the carrier beam, in the proximity of the top wall, preferably located in lateral regions of increased thickness where the top wall meets the side walls. In this case, fixed levers of modified configuration will be provided, each having a pair of angled lip formations to extend around the edges of the top wall and engage with the grooves provided in the side walls of the carrier beam. For example, generally L-shaped fixed levers of modified design may be provided, each lever having an upright arm in use to be arranged in generally vertical orientation, and a transverse limb in use to be arranged in generally horizontal orientation, a pair of spaced and opposed and in use generally downwardly and inwardly angled lip formations being provided on the transverse limb; the arrangement being such that the fixed lever may be arranged with its transverse limb straddling the carrier beam and with the lip formations engaging within the grooves to releasably secure the fixed lever to the carrier beam.

The lip formations may be provided on the underside of the transverse limb. Instead, the lip formations may be provided on a pair of spaced and opposed depending flanges formed on the transverse limb, the flanges being configured in use to extend generally downwardly adjacent opposed side walls of the carrier beam. At least one of the flanges may be formed to have sufficient resilience to allow the flange to be deformed resiliently, to engage the lip formation in the appropriate lateral groove provided in the side wall of the carrier beam.

In yet another embodiment, the complementary attachment means of the fixed levers and the carrier beam may comprise an attachment flange formation provided on a fixed lever, configured to be placed against a wall of the carrier beam, and securing means, such as a rivet or a screw, for securing the attachment flange of the lever to the wall of the carrier beam. A fixed lever may thus have an upright arm and a pair of perpendicular flanges, to be placed in abutting relationship against two adjacent walls of a carrier beam, e.g. the top wall and a side wall. Corresponding tapped holes may be provided in the carrier beam and one or both of the abutting flanges, to receive a securing screw.

According to a further feature of the invention, the carrier beams and the fixed levers, as well as some or all of the other components of the roof structure, may conveniently be made of an aluminium-based material, e.g. an aluminium alloy. The use of an aluminium alloy material provides important practical advantages, such as a reduction in overall mass of the components and thus of the roof structure, improved resistance to corrosion e.g. rust, enhanced appearance, and more importantly, beneficial mass manufacturing possibilities, etc.

Making some of the components of an aluminium alloy also involves the possibility of making at least some components by an extrusion process, thereby enabling novel configuration designs to be used. Aluminium-based materials are, however, difficult to weld. Accordingly, the use of a releasable attachment means as envisaged in the present invention has been found to be particularly advantageous in respect of aluminium-based components, for mounting the fixed levers on the carrier beams.

According to another aspect of the invention, a carrier beam may be an extruded component of an aluminium-based material, preferably having a cross-sectional profile to provide optimum strength, particularly bending strength, in relation to quantity of material used. A carrier beam may thus be a hollow, tubular extruded component, having a generally rectangular exterior configuration with a pair of opposed side walls and opposed top and bottom walls, the side walls being of substantially greater height than the width of the top and bottom walls and of substantially smaller wall thickness.

In a particular embodiment, a carrier beam of aluminium-based material in the form of an extruded hollow tubular member as described above, may have side walls of about 90 mm in height and about 2,5 mm wall thickness, and may have a bottom and top wall of about 38 mm in width, the top and bottom walls having a wall thickness of about 9 mm. The top wall may preferably be of varying thickness, having a central region of reduced thickness and lateral regions adjacent the side walls of increased thickness. The thickness of the central region may be about 7 mm and that of the lateral regions about 12–14 mm.

The grooves in the carrier beam for receiving the male engagement formations on the fixed levers, may be provided in the lateral regions of the top wall of the carrier beam, ie regions having increased thickness. The grooves may extend longitudinally along the length of the carrier beam.

According to a further aspect of the invention, the fixed levers may be cut from an elongate component configured to permit a plurality of fixed levers to be cut therefrom, e.g. along transversely orientated cutting lines. The elongate component may be an extruded component of an aluminium-based material. The extruded component may be of generally L-shaped configuration, having a first continuous limb to constitute the upright arms of a plurality of fixed levers, and a second continuous limb arranged at a suitable angle to the first limb to constitute the horizontal arms of a plurality of fixed levers to be cut from the component, e.g. along cutting lines disposed generally perpendicular to the longitudinal dimension of the extruded component. Continuous male engagement formations may be provided on the transverse arm, e.g. continuous protruding tongue formations, or continuous angled lip formations, as the case may be, or continuous perpendicular flanges may be provided, to constitute the attachment means on the levers cut from the component.

In similar manner as described more fully in the earlier patent, a plurality of pairs of mounting levers may be provided in respect of a carrier beam, the fixed levers of each pair being attachable to the carrier beam in spaced relationship at suitable intervals along its length, to carry a plurality of correspondingly spaced carrier elements. The free ends of the free levers of each pair of mounting levers operable on a carrier beam may be interconnected by means of an elongated connector; the arrangement being such that reciprocal displacement of the connector imparts reciprocal arcuate movement of the free levers to bring about pivotal displacement of the carrier elements and thus of the slats mounted on the carrier elements.

As further described in the earlier patent, a plurality of carrier beams may be provided adjacent one another in spaced parallel relationship such that pairs of mounting levers on adjacent carrier beams are substantially aligned, and a rotation rod may be provided to extend between selected aligned pairs of mounting levers on adjacent carrier beams, the rotation rod being secured to the selected mounting levers in such a manner that rotational motion of the rod around its longitudinal axis will bring about arcuate movement of the free levers of the aligned pairs of mounting levers, thereby imparting linear displacement to the connectors interconnecting the free levers carried on a carrier beam, so as to bring about pivotal displacement of the interconnected free levers, the carrier elements and thus of the slats. For mounting the rotation rod, the fixed lever of a selected pair of mounting levers is modified to support the rotation rod so as to permit rotational motion of the rod, and the free lever of the selected pair of mounting levers is modified to support the rotation rod in fixed relationship and to carry a carrier element, so as to transfer rotational motion of the rotation rod as pivotal movement to the carrier element.

As mentioned in the earlier specification, the earlier invention envisaged the provision of prefabricated carrier beams of suitable length, having mounted thereon a plurality of fixed levers and associated free levers, the carrier beam if necessary to be cut to the required length on site, where the roof structure is to be constructed. The provision of prefabricated components are also envisaged in the context of the present invention, including for example carrier beams of suitable length and a plurality of fixed lever components to be attached on site to the carrier beams, e.g. by means of the complementary tongue-and-groove attachment means, or the lip-and-groove attachment means, at suitable intervals along the length of the carrier beams. It will be appreciated that such prefabricated carrier beams and the accompanying unattached but readily attachable lever components in accordance with the present invention, may be packed and transported more conveniently than the prefabricated carrier beams with affixed levers as envisaged in the earlier specification.

It will further be appreciated that the fixed levers, having readily engageable engagement means, may be mounted on the carrier beams by unskilled persons and without the use of additional tools or equipment, e.g. without holes having to be drilled and rivets inserted, or without a welding joint having to be effected. The invention is thus suitable to be provided in the form of do-it-yourself construction kits.

According to the invention, there is thus provided a kit for constructing a louvre type roof structure as described above, the kit including a plurality of carrier beams of suitable length; and one or more composite units each of which unit comprises a plurality of carrier elements on which a plurality of slats are mountable, each carrier element carrying a pair of mounting levers, one of such pair of mounting levers being a fixed lever attachable to a carrier beam in a selected position, and the other one of such pair being a free lever displaceable relative to a said carrier beam; the fixed levers of each pair being rotatably attached to its carrier element, and the free levers of each pair being fixedly attached to its carrier element; the free levers of each pair further being interconnected by means of an elongated connector, and the fixed levers of each pair having releasable attachment means for releasably attaching the fixed levers to a carrier beam in selected positions. The kit may also include a tool to determine the positioning and placement of a plurality of fixed levers on a carrier beam, the tool comprising an elongated placement member having key markings at selected spaced intervals along its length, to permit the placement member to be placed along a carrier beam and fixed levers to be releasably attached to the carrier beam with reference to the key markings.

The placement member may be a rod of angled configuration, ie having a pair of longitudinally extending flanges disposed at right angles to one another to enable the member to be positioned to straddle the carrier beam. The key marks may be cut-outs provided in one or both of the flanges, at selected intervals, whereby the levers to be attached may be placed in the cut-outs.

According to a further aspect of the invention, the free lever of a pair of mounting levers as described herein, instead of being a separate lever element secured to a relevant carrier element and a connector, may be formed integrally with a carrier element. Thus, a carrier element may be formed with an elongated extension portion to constitute a said free lever, the extension portion being of such longitudinal dimensions to enable the extension portions of a plurality of carrier elements to be interconnected by a connector in a manner to permit displacement of the connector to bring about unimpaired displacement of the carrier elements and slats mounted thereon between a closed and an open position.

The extension portion may be formed integrally when the carrier element is formed, and may be of a suitable shape and configuration. If desired, the extension portion may have a reinforcing rib or a deformation to impart rigidity to the free lever formed by such extension portion.

It will be understood that a selected pair of mounting levers on a composite unit may be modified to support a rotation rod so that rotational motion of the rod around its longitudinal axis will bring about displacement of the free levers, the connectors, and the carrier elements, as described more fully in the earlier specification.

BRIEF DESCRIPTION OF THE DRAWINGS

The invention and the manner in which it may be put into practice will now be described by way of example with reference to the accompanying diagrammatic drawings, in which.

DETAILED DESCRIPTION

Figure 1:
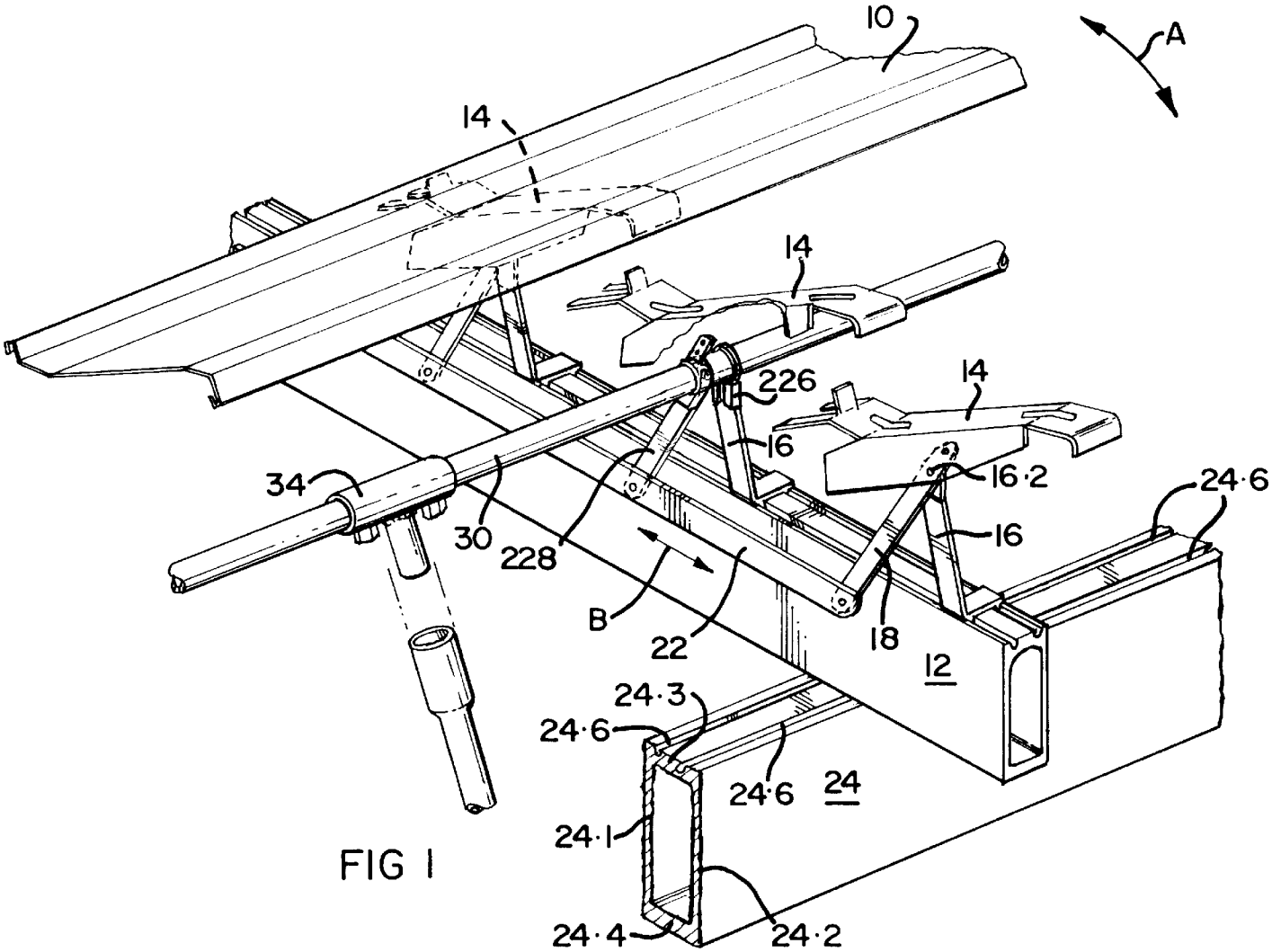
FIG. 1 is a partial three-dimensional representation depicting a part of a louvre type roof structure according to the invention.

Referring to FIGS. 1 to 16 of the drawings, in which parts corresponding to similar parts in the main specification have as far as possible been indicated with similar reference numerals, a louvre type roof construction according to the invention comprises a plurality of parallel louvre slats one of which is shown as 10, mounted on carrier beams one of which is shown as 12, extending transversely to the slats 10, by means of carrier elements 14. The carrier elements 14 are as described in the main specification. The carrier elements 14 are mounted on the carrier beams 12 by means of pairs of mounting levers comprising a fixed lever 16 and a free lever 18.

Figure 2:
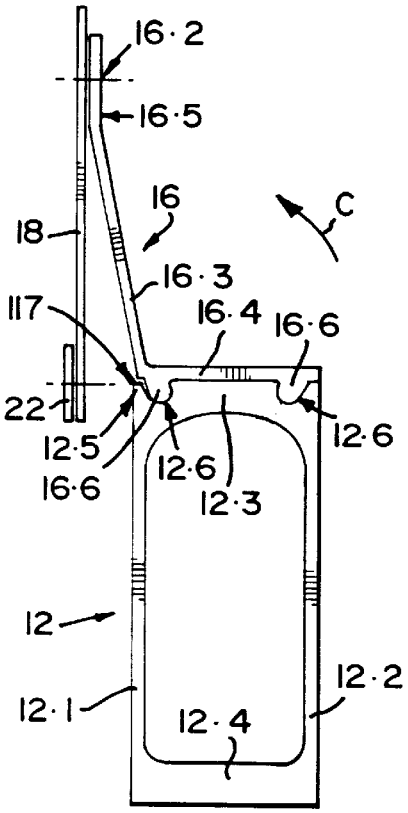
FIG. 2 is an end view of a carrier beam according to the invention, with a fixed lever attached thereto, and depicting a free lever and a connector for interconnecting a plurality of free levers.

In the embodiment shown in FIGS. 1–5, a fixed lever 16 may be of generally L-shaped configuration, having an upright arm 16.3 to be arranged in generally vertical orientation in use, and a transverse limb 16.4 to be arranged in generally horizontal orientation in use. The upper region 16.5 of the fixed lever is rotatably secured to a carrier element 14 at 16.2, e.g. by means of a rivet (not shown). It will be noted from FIG. 2 that the upper region 16.5 is offset relative to the rest of the upright arm 16.3, to enable the free lever 18 to be rotatably secured to the fixed lever 16 at 16.2 (as described more fully in the main specification), with adequate clearance, as depicted in FIG. 2.

As described in the main specification, the free levers 18 are interconnected at their lower ends by a connector rod 22, so that reciprocal movement of the connector 22 in the direction of the arrow B in FIG. 1 will bring about pivotal movement of the carrier elements 14, and thus also of the louvre slats 10, in the direction of the arrow A in FIG. 1.

The fixed lever 16 is provided with releasable attachment means in the form of a pair of spaced and protruding tongue formations 16.6 on the underside of the transverse limb 16.4. It will be noted that the tongue formations 16.6 are directed inwardly towards one another, to engage securely within complementary groove formations 12.6 provided on the carrier beam, as described more fully below.

Figure 3:
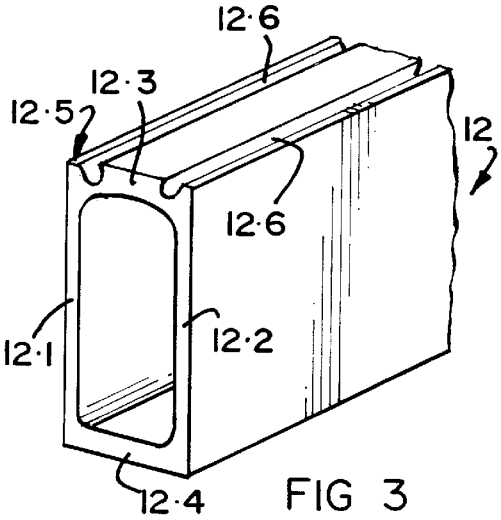
FIG. 3 is a three-dimensional view of part of the carrier beam.

The carrier beam 12 comprises a hollow tubular extruded component, preferably of an extrudable aluminium-based material, which is generally rectangular in cross-section, as is evident from FIGS. 2 and 3, having opposed side walls 12.1, 12.2 and a top wall 12.3 and bottom wall 12.4. It will be observed that the height of the side walls 12.1, 12.2 is substantially greater then the width of the top and bottom walls 12.3, 12.4. The side walls 12.1, 12.2 may for example, have a height of about 90 mm, and the width of the top and bottom walls 12.3, 12.4 may be about 38 mm. Further, it will be noted that the thickness of the side walls 12.1, 12.2 is substantially less than that of the top and bottom walls 12.3, 12.4. The thickness of the side walls 12.1, 12.2 may, for example, be about 2–5 mm while that of the top and bottom walls 12.3, 12.4 may be about 7–9 mm or more. It will be noted that the thickness of the top wall 12.3 increases from the middle outwardly, from a thickness of about 7 mm in the middle region to lateral regions of increased thickness of about 12 mm. This configuration enables carrier beams 12 of optimal strength and carrying capacity, particularly bending strength, to be made with a minimal mass of aluminium-based material.

In the top wall 12.3, on the outside face thereof, there is provided a pair of longitudinally extending groove formations 12.6 within which the tongue formations 16.6 of the fixed levers 16 are engageable. It will be noted that the grooves 16.6 are angled and are configured to be directed inwardly, ie towards one another, to be complementary to the configuration of the tongue formations 16.6.

By deforming the transverse limb 16.4 of the fixed lever 16 slightly, in the direction of the arrow C in FIG. 2, the tongue formations 16.6 of the fixed lever 16 may be snapped into the grooves 12.6 of the carrier beam 12, to secure the fixed lever 16 fixedly to the carrier beam 12. The deformation should preferably be within the elastic capacity of the fixed lever 16, which capacity is inter alia determined by the thickness of the transverse limb 16.4, to bring about a resilient deformation with a return to its original shape, and to avoid a plastic deformation which will bring about permanent loss of shape. It will be appreciated that this provides a quick and convenient method of attaching the fixed levers 16 to the carrier beam 12, without requiring a welding procedure.

If necessary, e.g. if the engagement between the tongue formations 16.6 and the grooves 12.6 should for any reason, e.g. wear of the die former used in the extrusion process, become less effective, further securing means may be provided, such as an adhesive bonding material, screws or rivets, or the like.

Figure 4:
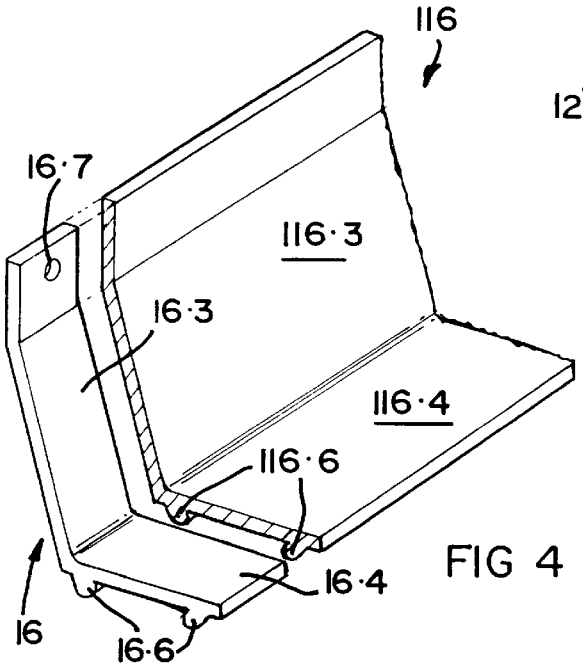
FIG. 4 is a three-dimensional view of part of an elongate component from which a plurality of fixed levers may be cut.

Reverting now more particularly to FIG. 4, there is illustrated how the fixed levers 16 may be made from an elongate extruded component 116, conveniently also of an aluminium-base material, and having a suitable profile to present an upright arm 116.3 and a transverse limb 116.4. Longitudinally extending tongue formations 116.6 are provided on the underside of the transverse limb 116.4, to constitute the tongue formations 16.6 on the fixed lever 16. A plurality of fixed levers 16 will in practice be cut from a component 116, each lever 16 conveniently having a width of about 20 mm.

It will further be noted from FIGS. 2 and 3, that the carrier beam 12 is provided with a slight bevelled or cut-away face 12.5 on the upper face thereof, adjacent a groove formation 12.6. The purpose of this bevelled face 12.5 is to present a gap between the carrier beam 12 and the fixed lever 16, shown as 117 in FIG. 2, into which a suitable tool, such as a screw driver, may be inserted to disengage the fixed lever 16 from the carrier beam 12, to remove the lever. This may be necessary when it is desired to adjust the position of a fixed lever 16. It will thus be appreciated that, although a lever 16 in use will be firmly attached to the carrier beam 12, it will in fact be releasably attached, to permit its removal.

Figure 5:
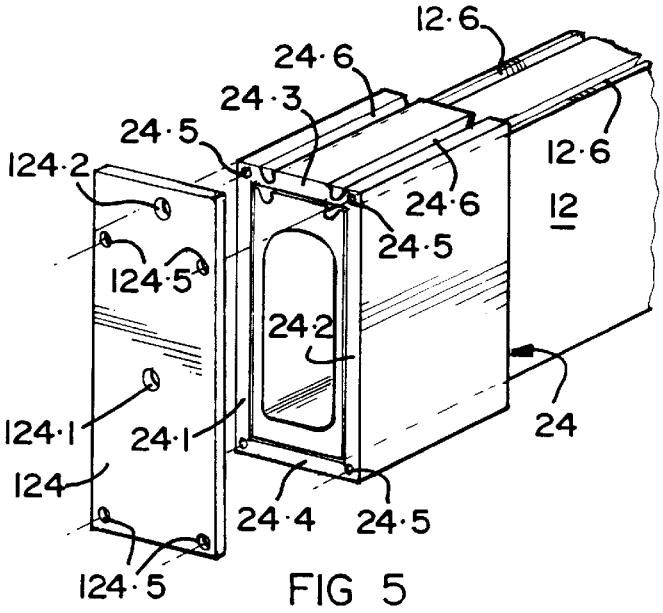
FIG. 5 is a partly exploded three-dimensional view of a carrier beam to illustrate the manner in which it may be mounted e.g. against a wall.

In FIG. 5 there is illustrated the manner in which a carrier beam 12 may be mounted against a wall or other support surface (not shown). As described in the main specification, the carrier beams 12 of a roof structure may themselves be supported on support beams which are disposed transversely to the carrier beams; such a support beam is shown as 24 in FIG. 1 of the accompanying drawings. A support beam 24 is also a hollow extruded tubular component, again preferably of an aluminium-based material, and of rectangular cross-sectional shape having side walls 24.1, 24.2 and a top and bottom wall 24.3 and 24.4 respectively. The support beam 24 is of such cross-sectional dimensions, that a carrier beam 12 is receivable within a support beam 24, as depicted in FIG. 5.

Reverting now to FIG. 5, a carrier beam 12 may be mounted with the aid of a short length of a support beam 24 the dimensions of which are such that the end portion of the carrier beam 12 is receivable within the piece of support beam 24. A mounting plate 124 is provided, and complementary holes 24.5 and 124.5 are provided in the piece of support beam 24 and the mounting plate 124 respectively, so that the mounting plate 124 may be secured to the piece of support beam 24 by means of screws. The mounting plate has further holes 124.1, 124.2 by means of which it may be secured to a wall or other support surface (not shown) to mount the carrier beam 12.

As illustrated, the support beam 24 is also provided with longitudinally extending groove formations 24.6, so that it may itself be used as a carrier beam where a sturdier roof construction is required.

In the main specification there is further described how reciprocal displacement of the free levers 18 and the connector 22 is brought about by means of a rotation rod 30 operatively connected to the fixed and the free levers 16, 18. To support the rotation rod 30, the levers 16, 18 occurring in the relevant position have to be modified. The present invention provides a variation of the means used for modifying the fixed lever 16 and the free lever 18, as will be described below.

Figure 6:
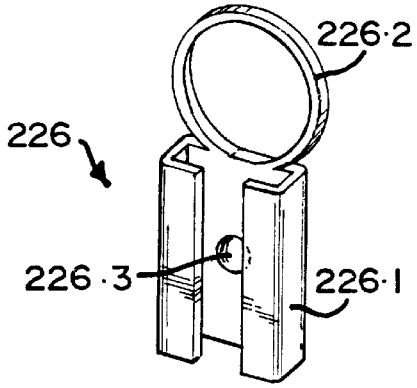
FIGS. 6 and 7 are three-dimensional views of modified embodiments of rotation rod support elements.

FIG. 6 depicts a modified rod support element 226 comprising an open channel-shaped bracket 226.1 shaped and dimensioned to fit around the upper portion 16.5 of the upright arm 16.3 of a fixed lever 16, and a ring 226.2 of diametral dimensions to receive the rotation rod 30. In use, the upper end of the upright arm 16.3 of the relevant fixed lever 16 will be cropped sufficiently for the lever to maintain its correct height when the rod support element 226 is mounted thereon. The rod support element 226 is then mounted on the cropped upright arm 16.3 with the channel-shaped bracket 226.1 extending around the cropped upper end, and the bracket 226.1 is secured to the arm 16.3, e.g. by pinching the bracket 226.1. Alternatively, the bracket 226.1 may be formed with a protuberance 226.3, and the lever arm 16.3 may be formed with a complementary depression (not shown), e.g. when the arm 16.3 is cropped, to enable interlocking engagement between the protuberance 226.3 and the depression to take place when the bracket is mounted on the cropped upright arm 16.3.

Figure 7:
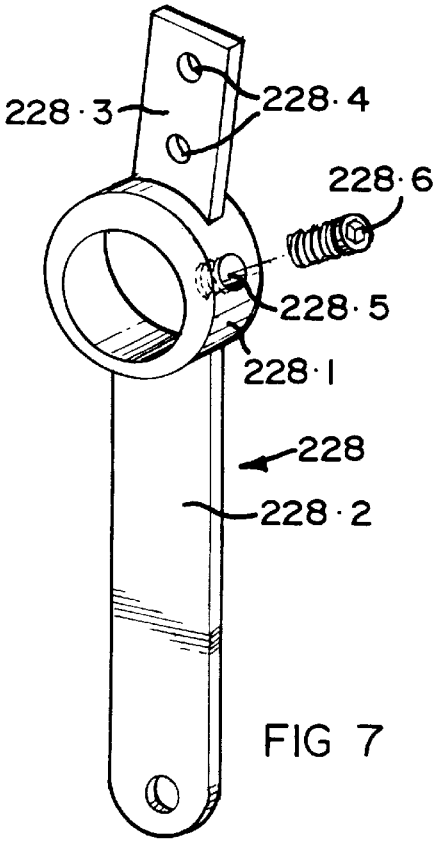

FIG. 7 depicts a modified rotation rod support element 228 to be substituted for a free lever 18 in the relevant position, the element 228 comprising a ring part 228.1 to receive the rotation rod 30, and a lever part 228.2 to replace and serve as the free lever 18. On the ring part 228.1 is provided a plate 228.3 on which the carrier element 14 is mounted by means of rivets through apertures 228.4; and an aperture 228.5 is provided for lockingly securing the ring part 228.1 to the rotation rod 30 by means of a grub screw 228.6.

It is an advantage of the modifying means as depicted in FIGS. 6 and 7 and described above, that a suitable number of pairs of the elements 226 and 228 may be threaded onto the rotation rod 30 (the number corresponding to the number of carrier beam assemblies to be serviced), whereupon the rotation rod 30 may be lowered onto the roof structure, and the threaded on elements may be secured to the cropped fixed levers 16 and the connector 22 in respect of each carrier beam 12. This facilitates installation of the rotation rod 30.

Figure 8:
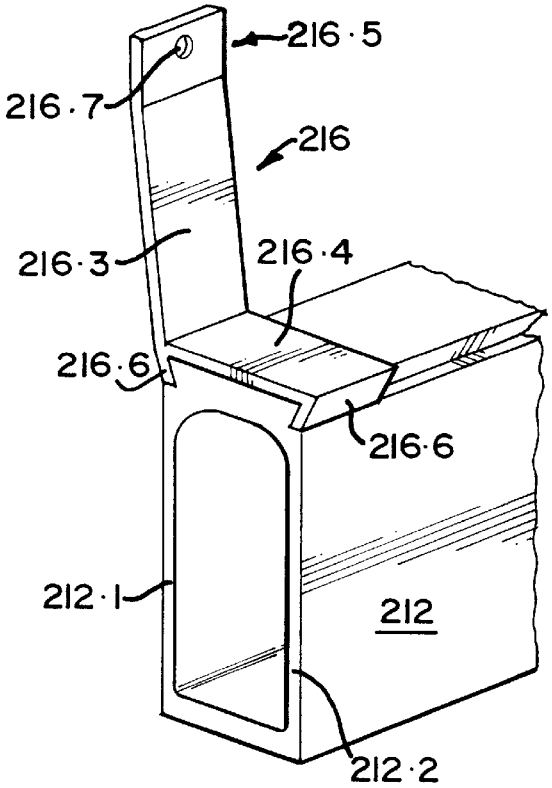
FIGS. 8 and 9 and 10 are partial three-dimensional views of alternative embodiments of fixed levers, shown mounted on carrier beams.
Figure 9:
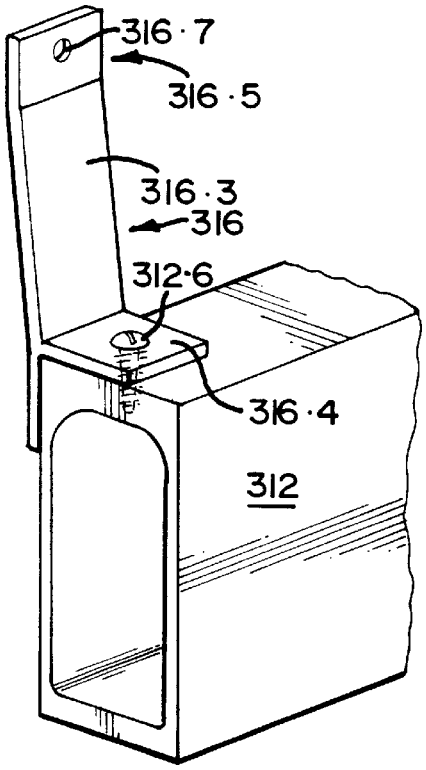
Figure 10:
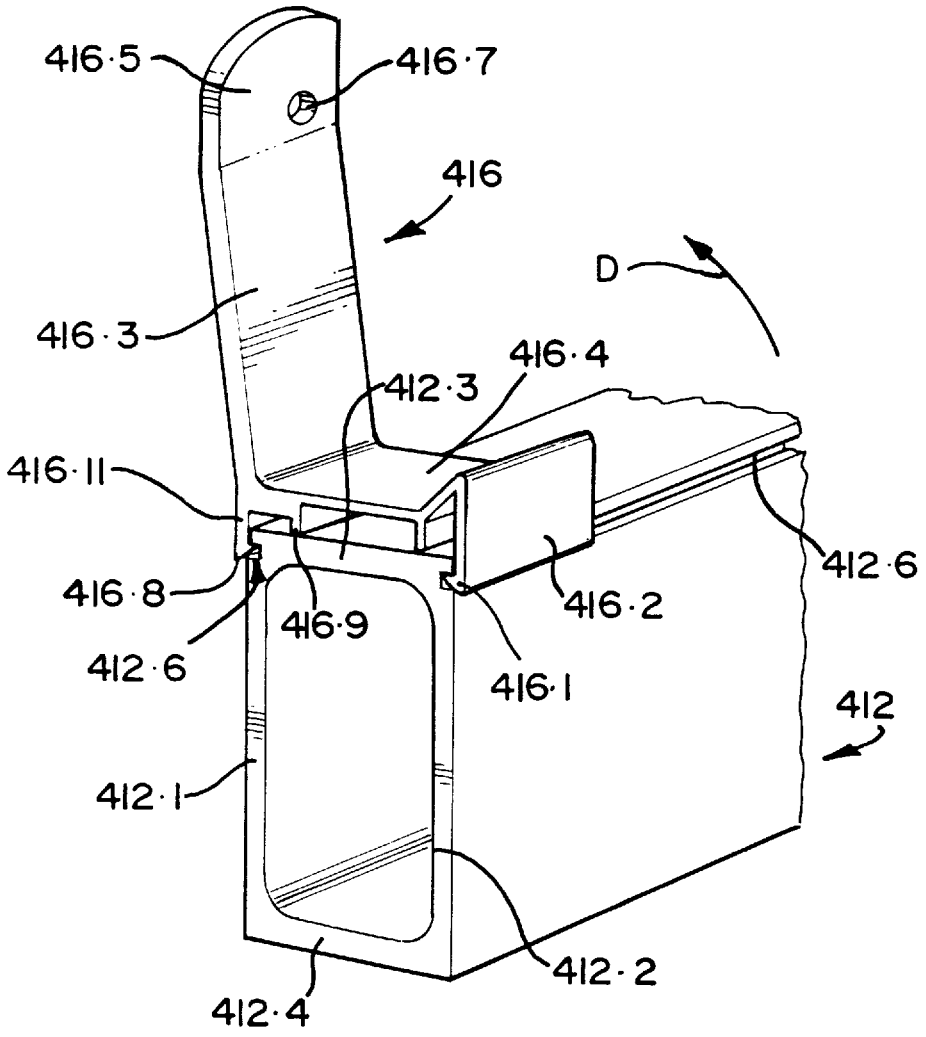
Figure 11:
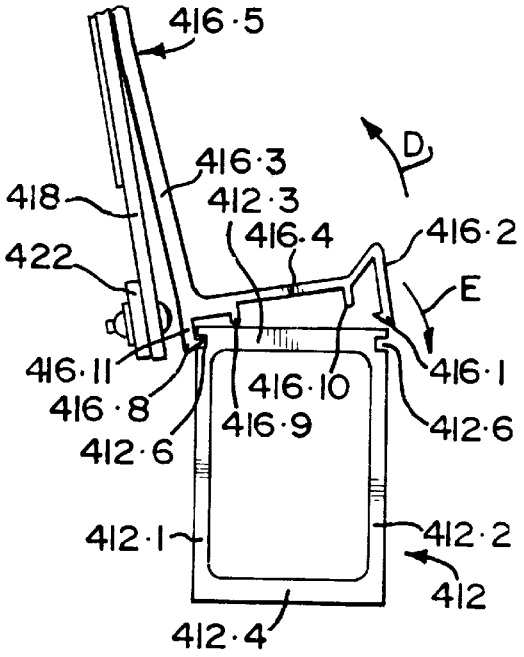
FIG. 11 is an end view of a carrier beam according to the invention, with the fixed lever of FIG. 10, to illustrate the manner in which the fixed lever will be attached to the carrier beam.
Figure 12:
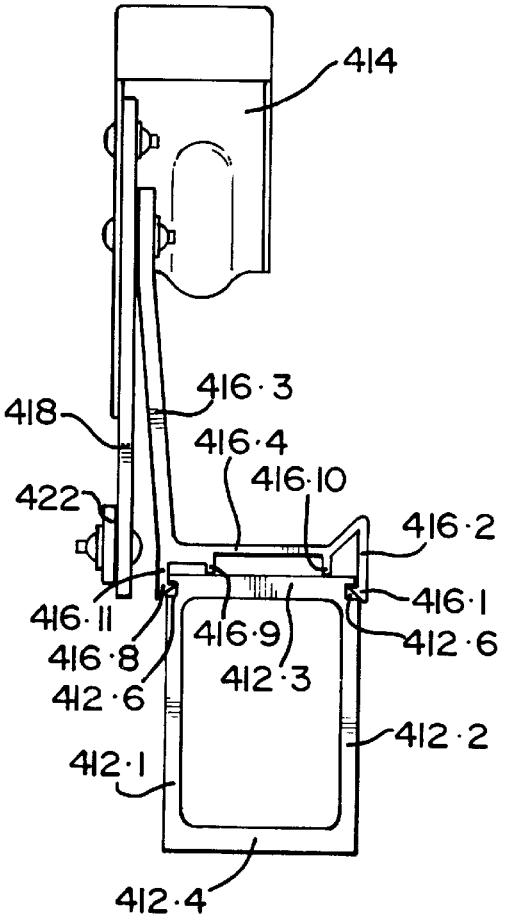
FIG. 12 is an end view of a carrier beam with the fixed lever of FIGS. 10 and 11 attached to it, and depicting also the free lever, connector and carrier element.
Figure 13:
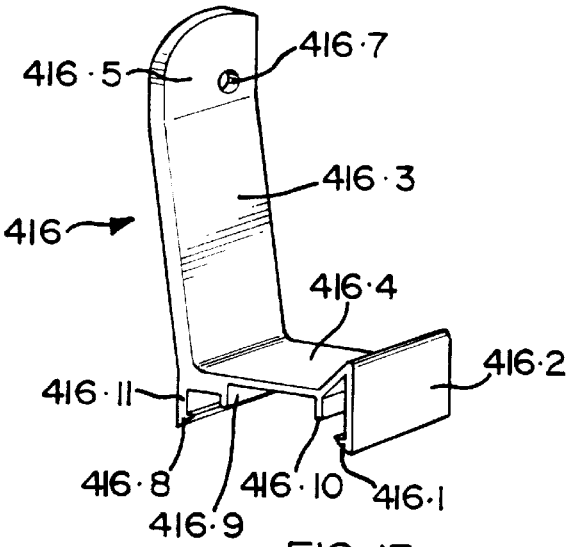
FIGS. 13 and 14 are three-dimensional views of the fixed lever of FIGS. 10–12, and a mounting lever for a rotation rod respectively.

Reverting now to FIGS. 8, 9 and 10, there are illustrated variations of the fixed lever 16. The fixed lever depicted in FIG. 8 is indicated generally as 216 and comprises an upright arm 216.3 and a transverse limb 216.4. The upper part 216.5 of the upright arm 216.3 is again off-set relative to the rest of the arm 216.3, and an aperture 216.7 is provided for connection of the fixed lever 216 to a free lever 18 and to a carrier element 14. On the underside of the transverse limb 216.4 there is provided a pair of spaced and downwardly angled lip formations 216.6 which are shaped to extend over and around the top edges of a modified carrier beam 212 to engage within lateral groove formations 212.6 provided in the side walls 212.1, 212.2 of the carrier beam 212. It will be observed that the modified carrier beam 212 is otherwise similar to the carrier beam 12 depicted in FIGS. 1–3.

The modified fixed lever 316 depicted in FIG. 9 again has an upright arm 316.3 with an off-set upper port 316.5 and an aperture 316.7. Instead of a transverse limb, the lever 316 has a pair of perpendicular attachment flanges 316.4 and 316.5, to be arranged to straddle a modified carrier beam 312. The flange 316.4 is attached to the beam 312 by means of a screw 312.6. It will be observed that the carrier beam 312 is again very similar in shape and configuration to the beam 12 depicted in FIGS. 1–3, except that it does not have the groove formations.

The modified fixed lever 416 depicted in FIGS. 10–13 and 15 comprises an upright arm 416.3 and a transverse limb 416.4. The upper part 416.5 of the upright arm 416.3 is again slightly off-set, as explained above, and an aperture 416.7 is provided for connection of the fixed lever 416 to a free lever 418 and to a carrier element 414. The transverse limb 416.4 is formed at its free end to present a generally inverted V-formation 416.2 having an inwardly directed lip formation 416.1 at its extremity. It will be appreciated that the V-formation will display resilience in practice, to allow it to be deformed resiliently in the direction of the arrow D in FIGS. 10 and 11.

At the opposed end of the transverse limb 416.4 there is provided a depending flange 416.11 with an inwardly directed lip formation 416.8 at its extremity. On the underside of the transverse limb 416.4 there is also provided a pair of spaced downwardly directed ridge formations 416.9, 416.10 for a purpose to be described below.

The lever 416 is shown mounted on a carrier beam 412, having side walls 412.1, 412.2 and a top wall and bottom wall 412.3, 412.4. The carrier beam 412 is generally of the same configuration and features as the carrier beam 12, except that the female attachment means is in the form of grooves 412.6 provided on the outside of the side walls 412.1, 412.2 near the top wall 412.3. It will be observed that the grooves 412.6 occur in the lateral regions of increased thickness, as described above.

In use, the lever 416 is mounted on the carrier beam 412 by first inserting the lip formation 416.8 in the appropriate groove 412.6, and then resiliently deforming the V-shaped formation 416.2 in the direction of the arrow D to engage the transverse limb 416.4 and the V-shaped formation 416.2 around the upper part of the carrier beam 412 and to engage the lip formation 416.1 into the appropriate groove 412.6. To bring the lip formation 416.1 into proper and secure engagement with the groove 412.6, it may be necessary to tap the V-shaped formation 416.2 and the transverse limb 416.4, such as with a hammer, in the direction of the arrow E shown in FIG. 11.

The ridge formation 416.9 abuts against, and bears against, the upper face of the top wall 412.3 of the carrier beam 412, to provide a secure and sturdy arrangement, by placing the flange 416.11 under tension and drawing the lip formation 416.8 more securely into the groove 412.6. It will be noted, as depicted in the drawings, that the portion of the transverse limb 416.4 adjacent the flange 416.11 and the flange 416.11 itself, are of greater wall thickness than the rest of the transverse limb 416.4 and the V-shaped formation 416.2. The reason for this is that the smaller wall thickness of the V-shaped formation 16.2 and the adjacent portion of the transverse limb 416.2 and the adjacent portion of the transverse limb 416.4 imparts greater resilience and deformability to those parts, to facilitate engagement of the lip 416.1 within the groove 412.6. On the other hand, the greater wall thickness of the other aforesaid parts improves the load-bearing capacity of those parts.

The ridge formation 416.10 likewise abuts against, and bears against, the upper face of the top wall 412.3 of the carrier beam 412, particularly during engagement of the lip 416.1 within the groove 412.6. The ridge formation 416.10 would thus prevent excessive deformation of the transverse limb 416.4 and the V-shaped formation 416.2.

In practice, the transverse dimensions of the transverse limb 416.4, ie from the flange 416.11 to the V-shaped formation 416.2, may also be slightly smaller than the transverse dimensions of the top wall 412.3 of the carrier beam 412, to ensure a secure engagement and grip of the lip formation 416.1, 416.8 within the grooves 412.6.

As explained before, and as illustrated in FIG. 15, the Applicant envisages the provision of a kit for constructing a louvre type roof structure according to the invention. Such a kit would include a plurality of carrier beams one of which is shown as 412, selected on the basis of suitable length, and a plurality of composite units one of which is shown as 415. Suitable composite units 415 will in practice be selected on the basis of the number of carrier elements 414 provided thereon, the selected composite units together to provide the required number of carrier elements 414 to carry the required number of slats to cover the roof area.

A composite unit 415 thus comprises a plurality of carrier elements 414 on which slats will be mountable, and a plurality of pairs of mounting levers 416, 418. The free levers 418 are interconnected by a connector 422, while the fixed levers 416 are secured to the carrier elements 414 in the manner described above.

To construct a roof structure, the carrier beams 412 will be mounted as explained more fully in the main patent, and the fixed levers 416 will be releasably attached to the carrier beams 412 in suitably selected positions, in the manner described above.

To determine the positioning and placement of the fixed levers 416 on the carrier beam 412, suitable key marks (not shown) may be provided on the carrier beam 412; or instead, a placement member (not shown) may be provided having suitably spaced key markings along its length, with the aid of which the fixed levers may be positioned.

Figure 14:
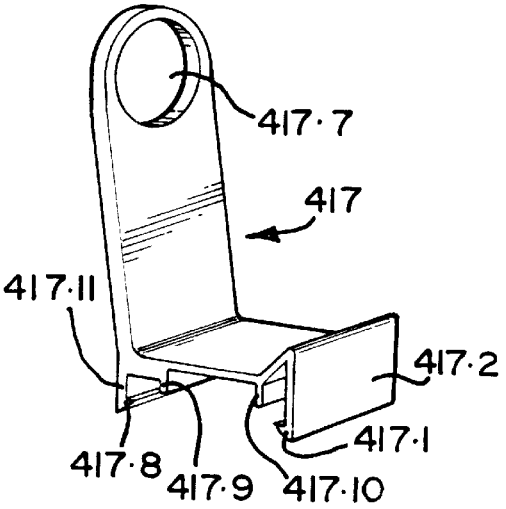
Figure 15:
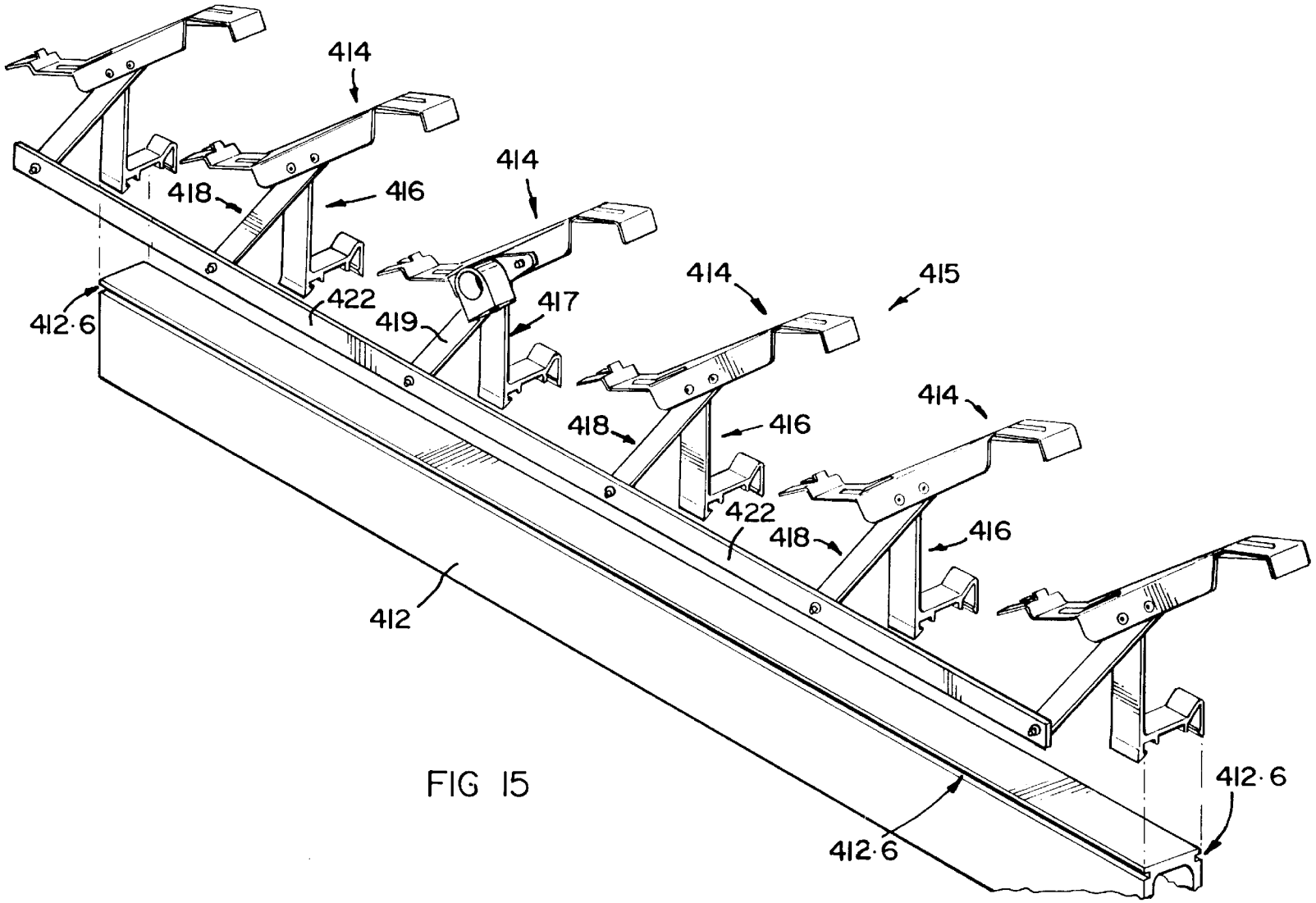
FIG. 15 is a partial three-dimensional representation, in partly exploded form, to illustrate a composite unit and a carrier beam forming part of a kit for constructing a louvre type roof structure according to the invention.

It will be noted that a composite unit 415 includes modified mounting levers for mounting a rotation rod (not shown in FIG. 15, but shown as 30 in FIG. 1). The modified mounting levers include a modified free lever 419, and a modified fixed lever 417. The modified fixed lever 417 is illustrated in FIG. 14. It will be observed that it is configured generally similarly to a fixed lever 416, being cut from the same extrusion, but is of greater width to allow for an aperture 417.7 to accommodate a rotation rod. Since the lever 417 has features corresponding to the fixed lever 416, including a flange 417.11 and lip formation 417.8, and a V-shaped formation 417.2 and lip formation 417.1, and ridges 417.9 and 417.10, it can be engaged with the carrier beam 412 in similar manner to the fixed lever 416.

Figure 16:
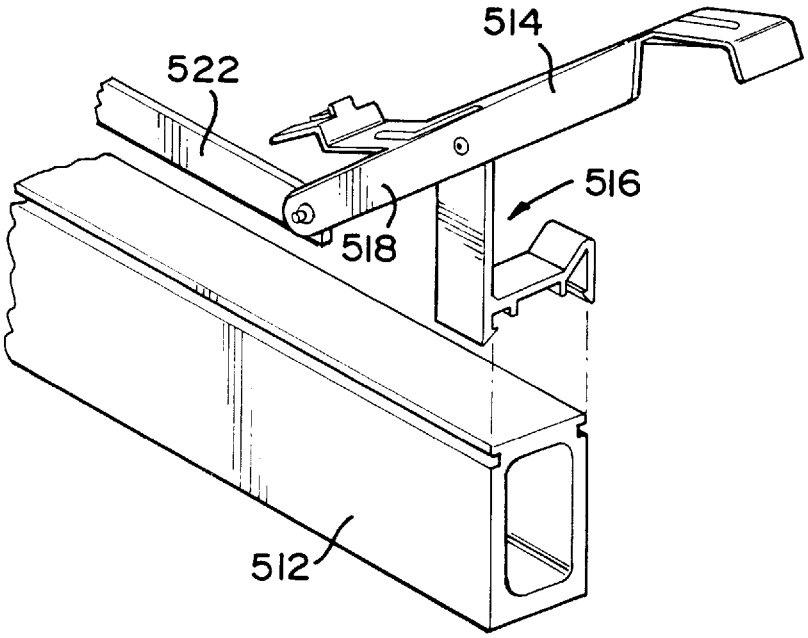
FIG. 16 is a partial three-dimensional view of an alternative embodiment, depicting a free lever formed integrally with a carrier element.

Referring now to FIG. 16, there is depicted an alternative embodiment of the invention, in which a free lever 518 is formed integrally with a carrier element 514. The carrier element 514 is thus of modified configuration, being formed with an elongated extension portion to constitute the free lever 518. A plurality of such free levers 518 may then be interconnected by means of a connector 522, in a manner similar to that shown in FIG. 15, to permit displacement of the connector 522 without interfering with the displacement of the carrier elements 514 (and the slats mounted thereon, not shown) between the open and closed positions. A fixed lever 516 of similar configuration as the lever 416 shown in FIG. 15, is rotatably secured to the carrier element 514, as described above. The fixed lever 516 is in turn releasably attached to a carrier beam 512, as described above, to construct a roof structure.

Figure 17:
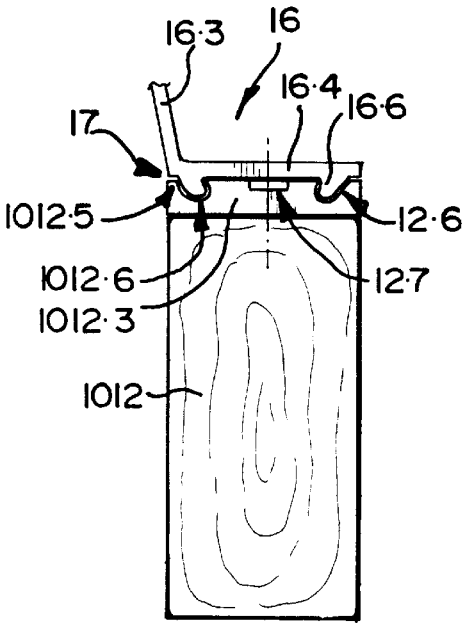
FIG. 17 shows, fragmentally, a development as applied similarly to the application or embodiment of FIG. 2.
Figure 18:
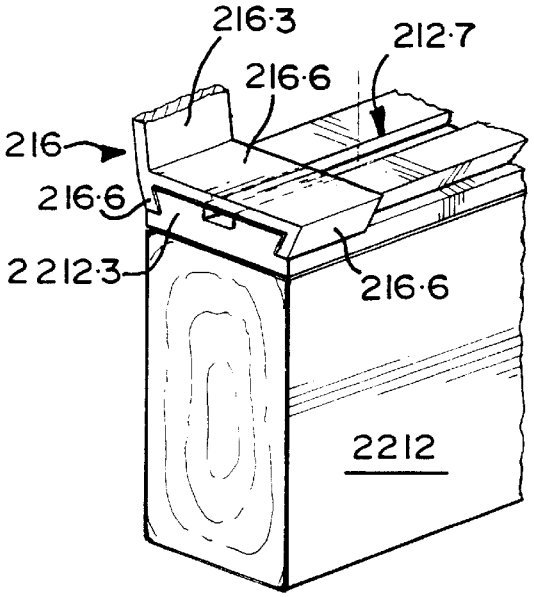
FIG. 18 shows fragmentally, the development of FIG. 17, applied similarly to the application or embodiment of FIG. 8.
Figure 19:
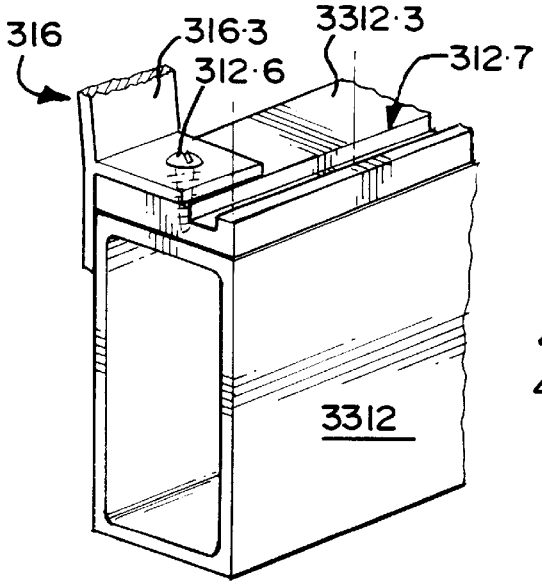
FIG. 19 shows, fragmentally, the development of FIG. 17, applied similarly to the application or embodiment of FIG. 9.
Figure 20:
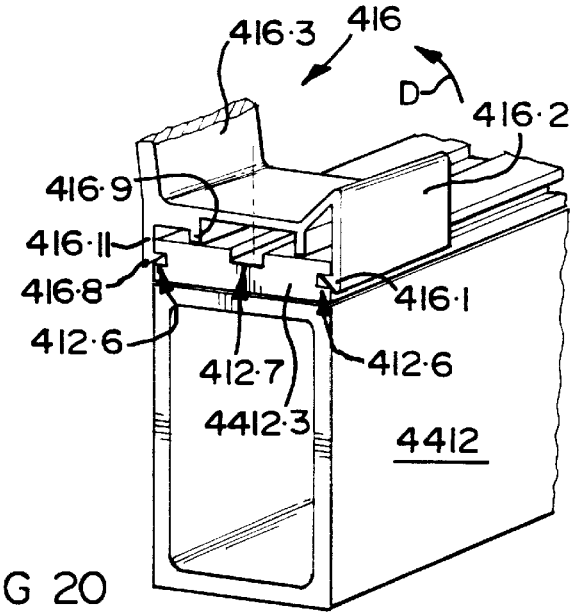
FIG. 20 shows, fragmentally, the development of FIG. 17, applied similarly to the application or embodiment of FIG. 10.
Figure 21:
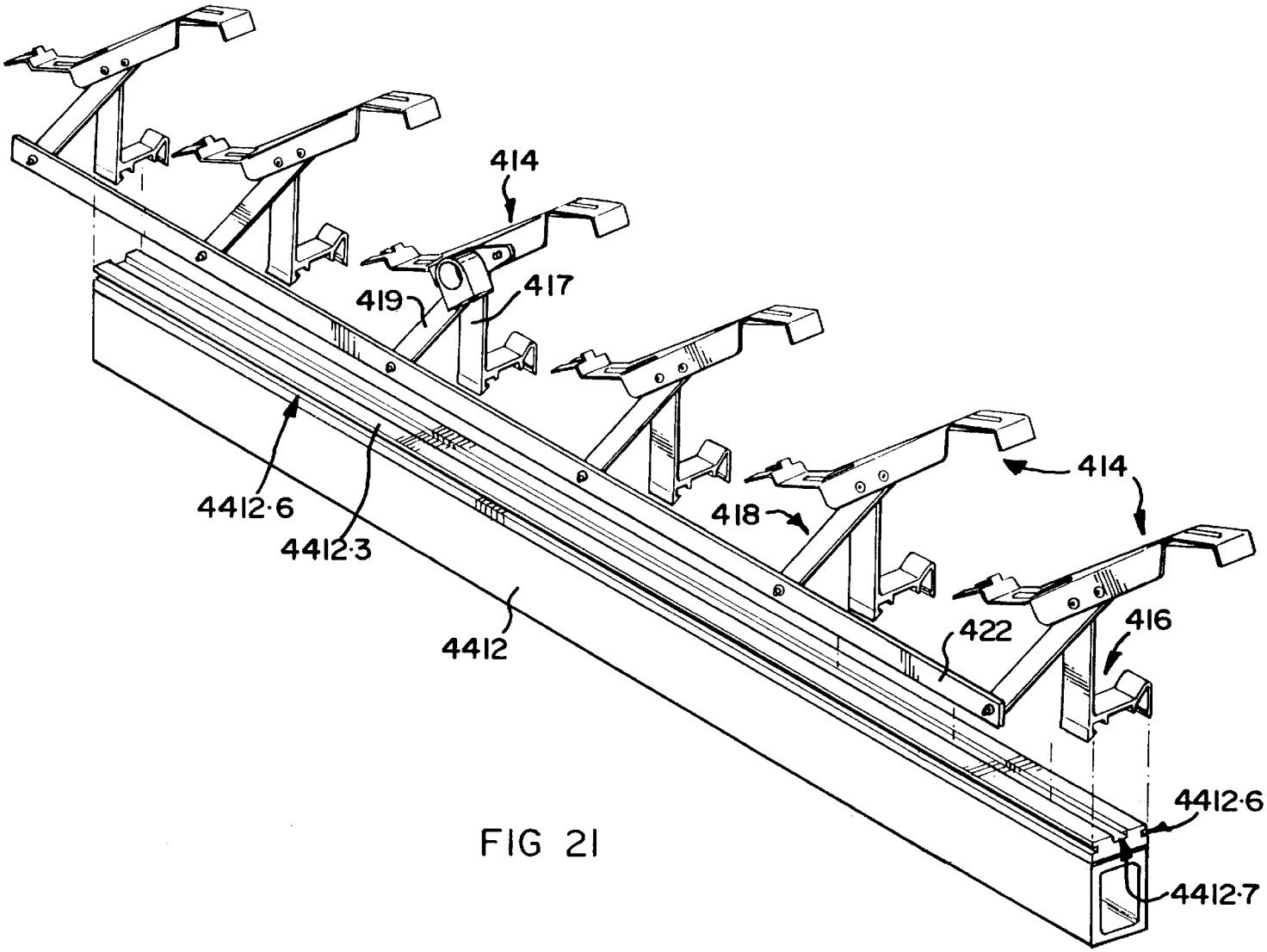
FIG. 21 shows, fragmentally, the development of FIG. 17, applied similarly to the application or embodiment of FIG. 15.
Figure 22:
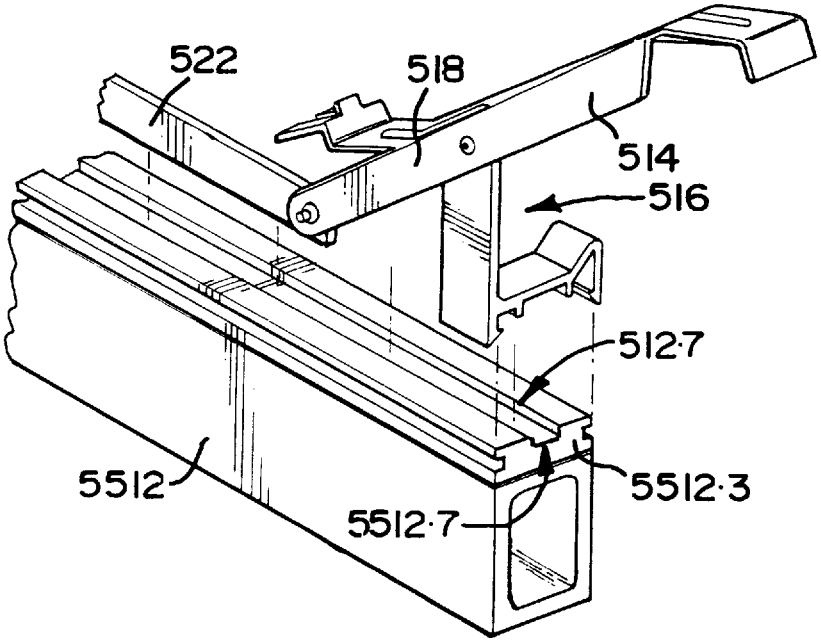
FIG. 22 shows, fragmentally, the development of FIG. 17, applied similarly to the application or embodiment of FIG. 16.

FIGS. 17 to 22 of the drawings show different applications or embodiments of a development of the applications or embodiments described above. For ease of perception, the development is illustrated in each of the respective FIGS. 17 to 22 in respect of applications or embodiments already illustrated and described above, and the same or similar reference numerals are conveniently used. For convenience, the information indication in the brief description of the drawings, is repeated, namely that FIG. 17 is analogous to FIG. 2;

FIG. 18 is analogous to FIG. 8;

FIG. 19 is analogous to FIG. 9;

FIG. 20 is analogous to FIG. 10;

FIG. 21 is analogous to FIG. 15;

FIG. 22 is analogous to FIG. 16.

The development is basically to provide an elongate, generally flat plate embodying the mounting formations provided at the top of the respective beam in the corresponding undeveloped embodiment or application to mount the respective fixed lever. This elongate flat plate can then be affixed in any convenient manner to an existing substrate such as an existing beam, thereby to mount the louvre type roof structure in accordance with this invention on an existing substrate. This has the important advantage that modular units can be supplied, in different lengths, to enable a louvre type roof structure in accordance with the invention to be erected in modular fashion on an existing substrate.

Even if an existing substrate does not exist, it is advantageous that a substrate can be provided in virtually any convenient or traditional manner and that the louvre type roof structure can be superimposed on such a substrate in modular fashion.

More specifically, with reference to FIG. 17, the fixed lever 16 of FIG. 2 is mounted in a fashion already described with reference to FIG. 2 on an elongate, generally flat plate 1012.3 corresponding to the upper portion 12.3 of the beam 12 of FIG. 2.

The elongate generally flat plate 1012.3 can be affixed in any convenient manner to an existing substrate, e.g. in the form of a timber beam 1012. To facilitate fixing, an elongate recess or groove 12.7 is provided in the plate 1012.3 such that nails, screws, or the like which have heads can be accommodated within the groove 12.7 without the heads protruding beyond the upper plane of the plate 1012.3.

With reference to FIG. 18, the fixed lever 216 of FIG. 8 is releasably mounted on an elongate, generally flat plate 2212.3 corresponding to the upper portion 212.3 of the beam 212 of FIG. 8.

In the embodiment of FIG. 18, the plate 2212.3 can be affixed in any convenient manner, e.g. by screws, nails or the like to a beam 2212 which is shown to be of timber in FIG. 18.

To facilitate mounting, a longitudinal recess or groove 212.7 is provided in the top of the plate 2212.3 to ensure that heads of the fasteners do not extend beyond the top plane of the plate 2212.3.

Similarly, with reference to FIG. 19, the lever 316 of FIG. 9 is releasably screwed by means of the screw 312.6 to an elongate flat plate 3312.3 corresponding to the upper portion 312.3 of the beam 312 of FIG. 9. In this case, the plate 3312.3 is screwed or otherwise fixed to an existing hollow section beam 3312 of steel. A groove 312.7 in the top of the plate 3312.3 facilitates neat mounting such that heads of fastener elements do not protrude.

Similarly, with reference to FIG. 20, the lever 416 of FIG. 10 is releasably mounted on an elongate generally flat plate 4412.3 corresponding to the upper portion 412.3 of the beam 412 of FIG. 10. In this embodiment, the plate 4412.3 is fixed by means of screws or the like to a conventional hollow section beam 4412 of steel. A groove 412.7 facilitates fixing such that heads of fastener elements do not protrude.

FIG. 21 illustrates a modular unit embodying the plate 4412.3 of FIG. 20 and a plurality of fixed levers 416, carrier elements 414, and the like of FIG. 15. This embodiment is virtually identical to the embodiment shown in FIG. 15, the only difference being that the beam 412 of FIG. 15 is replaced by the conventional beam 4412 and the elongate flat plate 4412.3 as described with reference to FIG. 20.

With reference to FIG. 22, an embodiment similar to the embodiment of FIG. 16 is shown, the only difference being that the beam 512 of FIG. 16 is replaced by a conventional beam 5512 in combination with an elongate generally flat plate 5512.3 having the mounting formations for the fixed levers 516. The flat plate 5512.3 can conveniently be secured to the beam 5512 by means of headed fasteners, the heads of which are concealed in a groove 512.7 in the top of the flat plate 5512.3.

Figure 23:
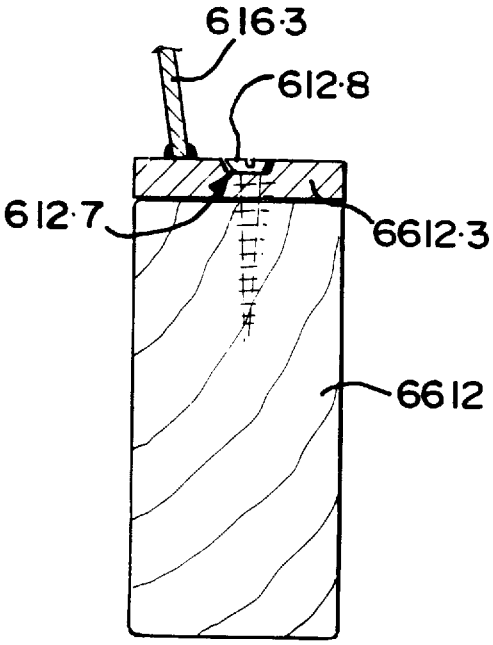
FIG. 23 shows, fragmentally, the development of FIG. 17, applied in a simplified manner similarly to the application or embodiment of FIG. 2.

With reference to FIG. 23, a simplified embodiment comprises an elongate, generally flat plate 6612.3 on which a plurality of levers, only one of which is shown with reference to its leg 616.3, are welded. The plate 6612.3 has an elongate groove 612.7 along a top thereof to allow heads of screws 612.8 fixing the plate 6612.3 to a timber beam 6612 to be recessed and thus not to protrude.

As mentioned above, the most important advantage of the development of FIGS. 17 to 23, is that modular units can be provided for mounting on an existing sub-structure or substrate and thus to form a louvre type roof construction on the existing sub-structure or substrate.

The inventiion claimed is:

1. A louvre type roof structure which includes a plurality of parallel slats mounted on carrier beams, which structure includes a plurality of carrier elements on which a corresponding plurality of slats are mountable;

mounting means for mounting the carrier elements on the carrier beams to permit pivotal displacement of the carrier elements and said slats mounted thereon between a closed position in which the slats are disposed in a roughly coplanar orientation, and an open position in which the slats are disposed in spaced apart generally parallel planes;

securing means for securing the carrier elements to the respective slats to engage the slats without penetrating the slats so that each slat will be located in a fixed planar orientation relative to the respective carrier element to which it is secured, said mounting means comprising a pair of mounting levers provided in respect of each of said carrier elements, one of a said pair of mounting levers being a fixed lever securable to a carrier beam in a selected position, and the other one of a said pair of levers being a free lever displaceable relative to a said carrier beam, said fixed lever being rotatably attached to the respective carrier element, and said free lever being fixedly attached to the respective carrier element to permit pivotal displacement of said carrier element relative to said fixed lever and carrier beam when said free lever is displaced relative to the carrier beam, said fixed lever being provided with releasable attachment means for releasably attaching said fixed lever to said carrier beam in a selected position, said carrier beam being provided with complementary attachment means for engaging with the attachment means of said fixed lever, said releasable attachment means of the fixed lever and said complementary attachment means of the carrier beam being in the form of complementary male and female engagement formations, which are respectively in the form of complementary tongue-and-groove formations, the fixed lever being provided with a pair of spaced protruding tongue formations, and the carrier beam being provided with a pair of spaced grooves, the spacing of the tongue formations being equidistant to the spacing of the grooves to permit the tongue formations to be engaged releasably within the grooves, the fixed lever being of generally L-shaped configuration having an upright arm to be arranged in generally vertical orientation in use, and a transverse limb to be arranged in generally horizontal orientation in use; and in which the tongue formations are arranged to protrude generally downwardly in use, and are provided on the transverse limb, said pair of complementary spaced grooves being provided in a face of the carrier beam which face is arranged to be generally upwardly directed in use.

2. A louvre type roof structure which includes a plurality of parallel slats mounted on carrier beams, which structure includes a plurality of carrier elements on which a corresponding plurality of slats are mountable;

mounting means for mounting the carrier elements on the carrier beams to permit pivotal displacement of the carrier elements and said slats mounted thereon between a closed position in which the slats are disposed in a roughly coplanar orientation, and an open position in which the slats are disposed in spaced apart generally parallel planes;

securing means for securing the carrier elements to the respective slats to engage the slats without penetrating the slats so that each slat will be located in a fixed planar orientation relative to the respective carrier element to which it is secured, said mounting means comprising a pair of mounting levers provided in respect of each of said carrier elements, one of a said pair of mounting levers being a fixed lever securable to a carrier beam in a selected position, and the other one of a said pair of levers being a free lever displaceable relative to a said carrier beam, said fixed lever being rotatably attached to the respective carrier element, and said free lever being fixedly attached to the respective carrier element to permit pivotal displacement of said carrier element relative to said fixed lever and carrier beam when said free lever is displaced relative to the carrier beam, said fixed lever being provided with releasable attachment means for releasably attaching said fixed lever to said carrier beam in a selected position, said carrier beam being provided with complementary attachment means for engaging with the attachment means of said fixed lever, said releasable attachment means of the fixed lever and said complementary attachment means of the carrier beam being in the form of complementary male and female engagement formations, which are respectively in the form of complementary tongue-and-groove formations, the fixed lever being provided with a pair of spaced protruding tongue formations, and the carrier beam being provided with a pair of spaced grooves, the spacing of the tongue formations being equidistant to the spacing of the grooves to permit the tongue formations to be engaged releasably within the grooves, the fixed lever being of generally L-shaped configuration having an upright arm to be arranged in generally vertical orientation in use, and a transverse limb to be arranged in generally horizontal orientation in use, in which a pair of spaced opposed and in use generally downwardly and inwardly angled lip formations are provided on the transverse limb, and a pair of complementary and in use generally outwardly directed grooves are provided in opposed in use generally outwardly directed lateral faces of the carrier beam, the arrangement being such that the fixed lever may be arranged with its transverse limb straddling the carrier beam and with the lip formations engaging within the grooves to releasably secure the fixed lever to the carrier beam.

3. A roof structure as claimed in claim 2, in which the lip formations are provided on a pair of spaced and opposed flanges formed on the transverse limb, the flanges being configured in use to extend generally downwardly adjacent opposed side walls of the carrier beam, at least one of the flanges being formed to have resilience to allow the flange to be deformed resiliently to engage the lip formation in the appropriate groove in the carrier beam.

4. A roof structure as claimed in claim 3, in which the fixed lever has a pair of spaced and in use generally downwardly extending ridge formations on the transverse limb, positioned inwardly of the lip formations, the ridge formations being arranged to abut against and bear downwardly against an upper face of the carrier beam when the fixed lever is releasably attached to the carrier beam.

5. A roof structure as claimed in claim 2, in which a plurality of fixed levers are sections cut from an elongate extruded component of an aluminium-based material, the extruded component being of generally L-shaped configuration having a first continuous limb to constitute the upright arms of the plurality of fixed levers, and a second continuous limb arranged at a suitable angle to the first limb to constitute the horizontal arms of the plurality of fixed levers; and in which continuous angled lip formations are formed on the said second continuous limb to constitute the attachment means on the plurality of fixed levers cut from the component.

6. A louvre type roof structure which includes a plurality of parallel slats mounted on bases, which structure includes:

a plurality of carrier elements on which a corresponding plurality of slats are mountable;

mounting means for mounting the carrier elements on the bases to permit pivotal displacement of the carrier elements and said slats mounted thereon between a closed position in which the slats are disposed in a roughly coplanar orientation, and an open position in which the slats are disposed in spaced apart generally parallel planes;

securing means for the carrier elements to the respective slats to engage the slats without penetrating the slats so that each slat will be located in a fixed planar orientation relative to the respective carrier element to which it is secured, said mounting means comprising a pair of mounting levers provided in respect of each of said carrier elements, one of a said pair of mounting levers being a fixed lever securable to the respective base in a selected position, and the other one of said pair of levers being a free lever displaceable relative to said base, said fixed lever being rotatably attached to the respective carrier element, and said free lever being fixedly attached to the respective carrier element to permit pivotal displacement of said carrier element relative to said fixed lever and base when said free lever is displaced relative to the base, said fixed lever being provided with releasable, adjustable attachment means for releasably, adjustably attaching said fixed lever to the respective base in a selected stepless position along the length of said base, said base being provided with complementary attachment means for engaging with the attachment means of said fixed lever, in which each base is in the form of an elongate strip mountable in parallel on an existing substrate over which the louvre type roof structure is to be erected such that when the fixed lever is longitudinally adjusted relative to the base it will also be longitudinally adjusted relative to said substrate.

7. A roof structure as claimed in claim 6 in which said releasable, adjustable attachment means of the fixed lever and said complementary attachment means of the base are in the form of complementary male and female engagement formations, which are respectively in the form of complementary tongue-and-groove formations, the fixed lever being provided with a pair of spaced protruding tongue formations, and the base being provided with a pair of spaced grooves, the spacing of the tongue formations being equidistant to the spacing of the grooves to permit the tongue formations to be engaged releasably within the grooves.

8. A roof structure as claimed in claim 6, in which each of said bases is in the form of an elongate strip which has a length, a width transverse to said length and smaller than said length, and a thickness transverse to both said length and said width and smaller than said width, said elongate strip being mountable on said existing substrate over which the louvre type roof structure is to be erected such that said existing substrate supports said elongate strip against bending in use.

9. A louvre type roof structure which includes a plurality of parallel slats mounted on bases, which structure includes:

a plurality of carrier elements on which a corresponding plurality of slats are mountable;

mounting means for mounting the carrier elements on the bases to permit pivotal displacement of the carrier elements and said slats mounted thereon between a closed position in which the slats are disposed in a roughly coplanar orientation, and an open position in which the slats are disposed in spaced apart generally parallel planes;

securing means for securing the carrier elements to the respective slats to engage the slats without penetrating the slats so that each slat will be located in a fixed planar orientation relative to the respective carrier element to which it is secured, said mounting means comprising a pair of mounting levers provided in respect of each of said carrier elements, one of said pair of mounting levers being a fixed lever longitudinally adjustable relative to the respective base for being fixed to the respective base in a predetermined position, and the other one of a said pair of levers being a free lever displaceable relative to said base, said fixed lever being rotatably attached to the respective carrier element, and said free lever being fixedly attached to the respective carrier element to permit pivotal displacement of said carrier element relative to said fixed lever and base when said free lever is displaced relative to the base, in which each base is in the form of an elongate strip which has a length, a width transverse to said length and smaller than said length, and a thickness transverse to both said length and said width and smaller than said width, said elongate strip being mountable in parallel on an existing substrate over which the louvre type structure is to be erected such that said existing substrate supports said elongate strip against bending in use and when said fixed levers are longitudinally adjusted relative to said elongate strip, said fixed levers will also be longitudinally adjusted relative to said existing substrate.

* * * * *